United States Patent [19]

Wagner

[11] 4,301,632

[45] Nov. 24, 1981

[54] PREFABRICATED MODULE AND METHOD FOR MAKING ARCHWAYS THROUGH BUILDING INTERNAL WALLS

[76] Inventor: James A. Wagner, 1818 Twin Ridge Blvd., Omaha, Nebr. 68105

[21] Appl. No.: 32,011

[22] Filed: Apr. 20, 1979

[51] Int. Cl.[3] ..... E06B 1/04

[52] U.S. Cl. ..... 52/211; 52/745; 52/86; D25/60

[58] Field of Search ..... 52/204, 211, 213, 745, 52/86; D25/60

[56] References Cited

U.S. PATENT DOCUMENTS

| | | | |
|---|---|---|---|
| 2,005,572 | 6/1935 | Vass | D25/60 X |
| 2,011,796 | 8/1935 | Christensen | D25/60 X |
| 2,064,704 | 12/1936 | Vass | 52/213 X |

*Primary Examiner*—Price C. Faw, Jr.
*Assistant Examiner*—Carl D. Friedman
*Attorney, Agent, or Firm*—Zarley, McKee, Thomte, Voorhees & Sease

[57] ABSTRACT

Internal walls of building structures include a plurality of longitudinally spaced-apart studs extending vertically between floor and ceiling levels and a horizontally longitudinally extending top-plate atop the vertical studs and extending a finite vertical-depth below ceiling level. Disclosed herein are novel prefabricated modules and methods for defining the upper portion of an arbitrarily selectably shaped archway to be constructed through the building interior wall. The prefabricated modules comprise a pair of parallel upright panels maintained in finite lateral-separation with internal bracing means including vertical rails attachable alongside upper portions of neighboring studs flanking the intended archway. The module also comprises arbitrarily selectably shaped archway delineating means extending laterally between the panels and spaced more than said vertical-dept below the module top-edge and intervening portions of the bracing means.

10 Claims, 11 Drawing Figures

PREFABRICATED MODULE AND METHOD FOR MAKING ARCHWAYS THROUGH BUILDING INTERNAL WALLS

It is oftentimes desired to construct a closure-less walk-through "archway" of some arbitrarily selectable shape through a building internal wall. So-called "archway" openings are increasingly being utilized for internal walls of residential and commercial buildings, the closure-less "archway" opening having some arbitrarily selected shape according to the aesthetic tastes of the architect or the intended building occupant. Typically, and primarily for practical considerations (though not absolutely necessary), lower portions of the archway are straight and vertical. However, upper portions of the archway portal, commencing a foot or so below ceiling level, might be of most any arbitrarily selectable shape according to one's aesthetic tastes.

In the prior art, archway openings through internal building walls are made by cutting through two layers of laterally separated drywall 107 or other sheathing attached to both sides of the vertical studs 105 including sheathing 107 spanning the distances "SS" between neighboring studs 105C–105D flanking the intended archway. As indicated in FIGS. 1 and 1A of the drawing, internal building walls typically comprise a longitudinally horizontally extending top-plate 110 upon stud-tops 106 and directly abutting and extending a finite vertical-depth "VD" below ceiling level 114. The following environmental elements are oftentimes provided of "2×4" wooden members: joists 101 for horizontal flooring 102, ceiling joists 113 (to the underside of which ceiling 114 is attached), the vertical studs 105, the two layers 111 and 112 of top-plate 110, and the floor-riser 103 lying upon flooring 102 and to which member 103 the studs 105 are attached. Thus, studs 105, floor-riser 103, and top-plate 110 are normally of the same finite lateral-extent "LS" e.g. the smaller cross-sectional dimension of the rectangular "2×4's", and of course, the value "LS" is the lateral-spacing between sheathing 107. In the prior art, after the "archway" opening is manually cut through the sheathing layers 107 spanning the neighboring studs 105C–105D, the workman fills-in the openings by applying laterally extending thin strips of suitable conformable sheet material, such as drywall, etc., which can be painted, papered, or otherwise provided with conventional decorative surfacing. However, such archway making techniques of the prior art are deficient in that they are laborious and generally awkward to perform, time consuming, expensive, not amenable to the provision of smoothly contoured archways, not amenable to the provision of exotically shaped archways, and lacking horizontal alignment of the archway opening at the wall exterior surfaces e.g. parallel sheathing 107.

It is accordingly the general objective of the present invention to provide prefabricated modules and ancillary installation methods for making archway openings of numerous arbitrarily selectable shapes and which overcome the several disadvantages and deficiencies of the prior art. It is a related general objective to provide prefabricated modules for defining the upper portion of the desired shaped archway, which provides an aesthetically attractive and geometrically true opening, which can be painted or otherwise surface decorated in conventional fashion, which is of low cost, and which is readily installable by workmen having but rudimentary skills.

With the above and other objects and advantages in view, which will become more apparent as this description proceeds, the prefabricated module comprises a pair of parallel upright panels maintained in finite lateral-spacing "LS" with internal bracing means, each of said panels having horizontal top-edge and bottom-edge and defining a constant vertical-height less than the vertical-elevation between floor and ceiling levels, the internal bracing means being relegated to a recessed-depth below the panels co-elevational top-edges to provide a modules overhang portion and the bracing also including a pair of parallel spaced-apart vertical rails ultimately attachable to upper portions of the neighboring studs, and arbitrarily shaped archway delineating means attached to and laterally extending between the module panels, and the module installation steps including placing uprightly between the neighboring studs and attaching module rails and overhang to the studs and top-plate, respectively, and placing crutch members beneath the module rails to maintain the module elevated condition as the archway upper portion.

In the drawing, wherein like characters refer to like parts in the several views, and in which.

Figure 1:
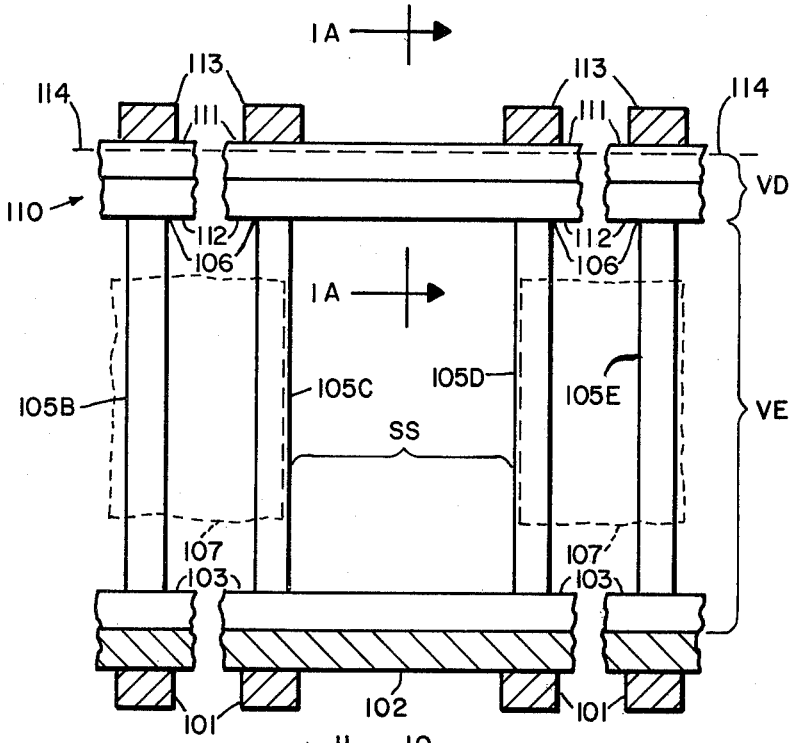
FIG. 1 (PRIOR ART)
FIG. 1 is a side elevational view of the prior art wall environment for which the modules and method of the present invention might be employed for making and defining the archway upper portion.
Figure 6:
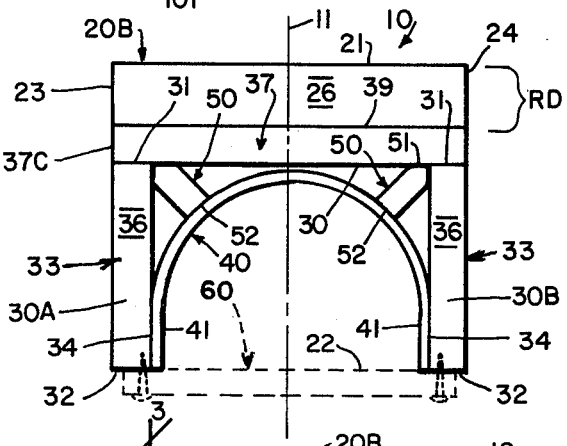
FIG. 6 is a sectional elevational view taken along line 6—6 of FIG. 5.

Turning initially to FIGS. 2–6 which depict module first embodiment 10, there is a pair of parallel upright panels 20A and 20B maintained in finite lateral-separation "LS" between their broad hidden-surfaces 26 with internal bracing means e.g. 30, 37, whereby the panels' horizontal top-surfaces 21 and horizontal bottom-edges 22 are respectively co-elevational. Thus, the module 10 has a constant vertical-height between edges 21–22 which is less than, and preferably substantially equal to, vertical-elevation "VE" between floor and ceiling levels. Similarly, by virtue of said internal bracing means, the panels vertical first-edges 23 and vertical second-edges 24 are respectively maintained in lateral alignment. Accordingly, module 10 has a constant longitudinal length 23–24 which is substantially equal to the said longitudinal-spacing "SS" between neighboring studs 105C–105D. For panels 20A and 20B, drywall sheathing like for sheathing 107 might be employed whereby planar broad surfaces 26 and 27 of each panel are parallel to each other of about ½ inch separation. Though each of the panels has a shape of rectangular outline 21–24, there is a centrally removed portion intersecting bottom-edge 22 of the shape desired for the archway delineating means e.g. 40, 45.

The internal bracing means necessarily comprises a pair of longitudinally spaced-apart parallel rails 30 having co-elevational top-ends 31 recessed below panels top-edges 21, having co-elevational bottom-ends 32 co-elevational with panels bottom-edges 22, and having planar upright surfaces 36 abutting panels hidden-surfaces 26. Rails 30 might take the form of "2×4" members, the cross-sectionally larger dimension providing the vertical planar surfaces 33 and 34 (both having lateral-extent "LS" between planar intervening surfaces 36), surfaces 33 ultimately abutting against the neighboring studs 105C–105D and the surfaces 34 abutting the lower-length portions e.g. 41, 46, of the archway delineating means. In this vein, the upright surface 33 of rail 30A is conterminous panels first-edges 23 and in FIGS. 9–10 abuts against stud 105C while upright surface 33 of rail 30B is conterminous panels second-edges 24 and in FIGS. 9–10 abuts against stud 105D. Rails 30 are attached to panels 20 with appropriate attachment means e.g. nails, adhesive, etc., and in such condition the rails smaller cross-sectional sides 36 abut panels hidden-surfaces 26.

Preferably, the internal bracing means additionally comprises a horizontal bar portion 37 located between panels 20A and 20B and having a planar underside 38 resting downwardly upon rails top-ends 31. The horizontal bar 37 is attached to panels 20 and desireably also to rails 30 by appropriate attachment means e.g. nails, adhesive, etc. Horizontal bar 37 is of substantially longitudinal-spacing "SS" between its upright ends 37C and 37D, bar planar end 37C being conterminous with panels first-edges 23 and in FIGS. 9–10 abuts against stud 105C while bar planar end 37D is conterminous with panels second-edges 24 and in FIGS. 9–10 abuts against stud 105D. Bar 37 might be a said "2×4" rectangularly cross-sectioned member, the cross-sectionally larger dimension providing underside 38 and upperside 39 while the cross-sectionally smaller dimension abuts panels hidden-surfaces 26. When the horizontal bar 37 provides the upper horizontal extremity 39 of the bracing means, it is disponsed a constant recessed-depth "RD" below panels top-edges 21 and defining said module overhang "RD" substantially equivalent said vertical-distance "VD".

There are arbitrarily shaped archway delineating means e.g. 40, 45, etc., attached to both panels along their geometrically similar centrally removed portion and laterally extending between and attached to panels 20 at their hidden-faces 26 with appropriate attachment means. The archway delineating means is throughout linearly generated and having a lateral-extent "LS" between parallel panels 20. The archway delineating means is restricted between the confines of rails 30 and has finite lower-length vertical portions e.g. 41, 46, closely spaced to and preferably in directly abutting attached relationship to the rails' vertical inner-faces 34. Drywall sheathing or other flexibly conformable sheet material of constant given-thickness might provide the archway delineating means which takes the arbitrarily selected semi-circular shape 40–41 for embodiment 10.

Desireably, there are reinforcement means e.g. 50, located between the panels 20 and relegated below the overhang "RD", and reinforceably maintaining the distance between the bracing means rails and the archway delineating means. Herein, the reinforcement means takes the form of a plurality of strengthening-ribs 50, each rib having an arch-end 52 matching that of the archway above its lower-length and having its other end 51 abutting the bracing means, ends 51 and 52 being attached to bracing 30 and archway 40, respectively. Each of the strengthening-ribs might be made of a "2×4" member abutting hidden-surfaces 26 and attached to panels 20, so as to complement the bracing means.

So as to prevent inward compression of the modules 10, 70, etc., toward its vertical-axis 11 during shipment and pre-installation storage and handling, a longitudinally extending stiffener member might be removably attached to lower-lengths of rails 30. For example, the stiffener rib-like member might take the form of lath strip 60 removably attached, as by nails 61, to rail bottom-ends 32.

Figure 7:
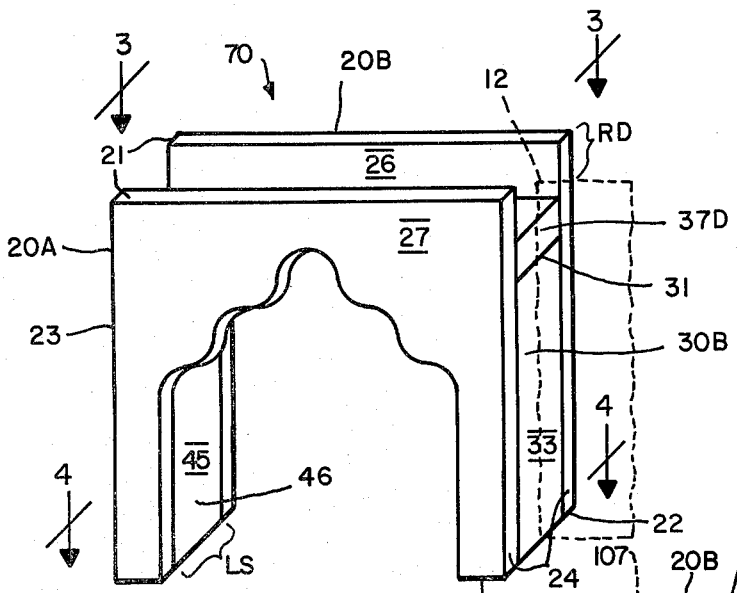
FIG. 7 is a perspective view of a second embodiment differing from the FIG. 2 first embodiment only for the shape of the archway delineating means.
Figure 8:
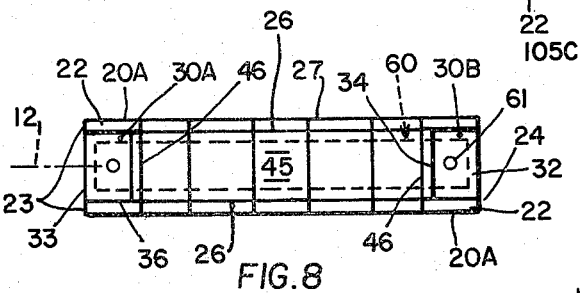
FIG. 8 is a bottom plan view analagous to FIG. 5 of the second module embodiment of FIG. 7.
Figure 4:
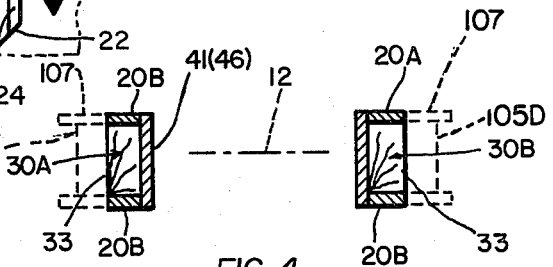
FIG. 4 is a sectional plan view taken along lines 4—4 of FIGS. 2 and 7.
Figure 3:
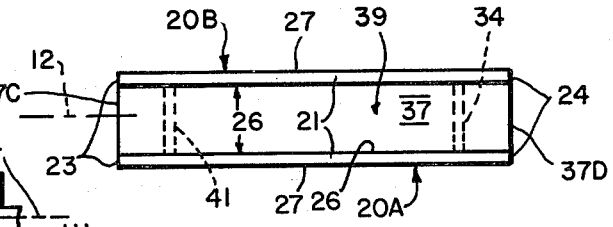
FIG. 3 is a top plan view of the first and second representative embodiments.

Module embodiment 70 of FIGS. 7–8 differs from embodiment 10 only in that the archway delineating means 45, above its straight lower-length 46, is of a more ornate shape than the semi-circular shape of embodiment 10. Embodiment 70 indicates but one of many possible non-semicircular shapes arbitrarily selectable for the archway, depending solely upon the architect's aesthetic taste.

Figure 1A:
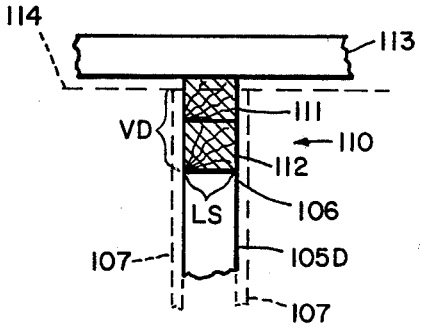
FIG. 1A PRIOR ART
FIG. 1A is a laterally extending sectional elevational view taken along line 1A—1A of FIG. 1.
Figure 2:
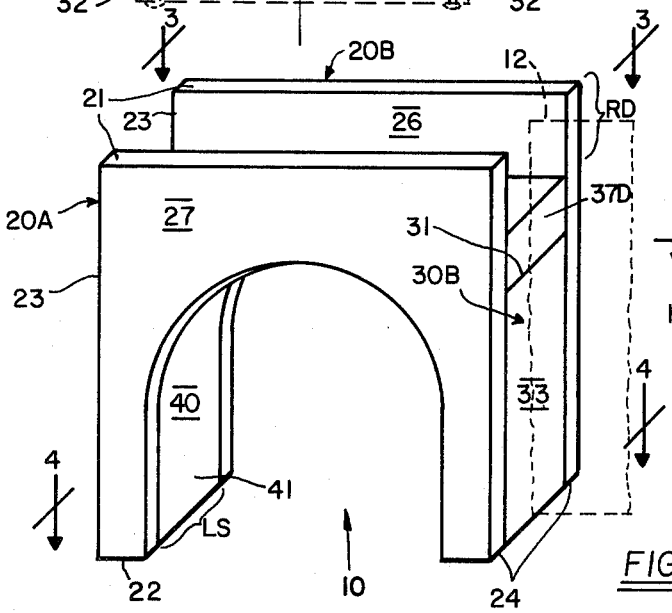
FIG. 2 is a perspective view of a first representative embodiment of the archway module of the present invention.
Figure 5:
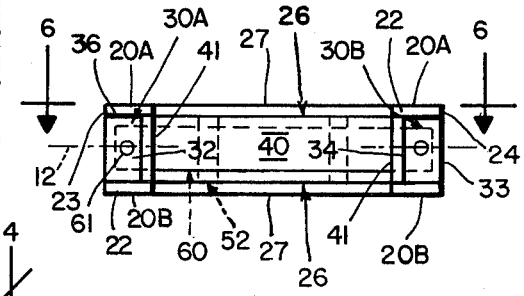
FIG. 5 is a bottom plan view of the first module embodiment of FIG. 2.
Figure 9:
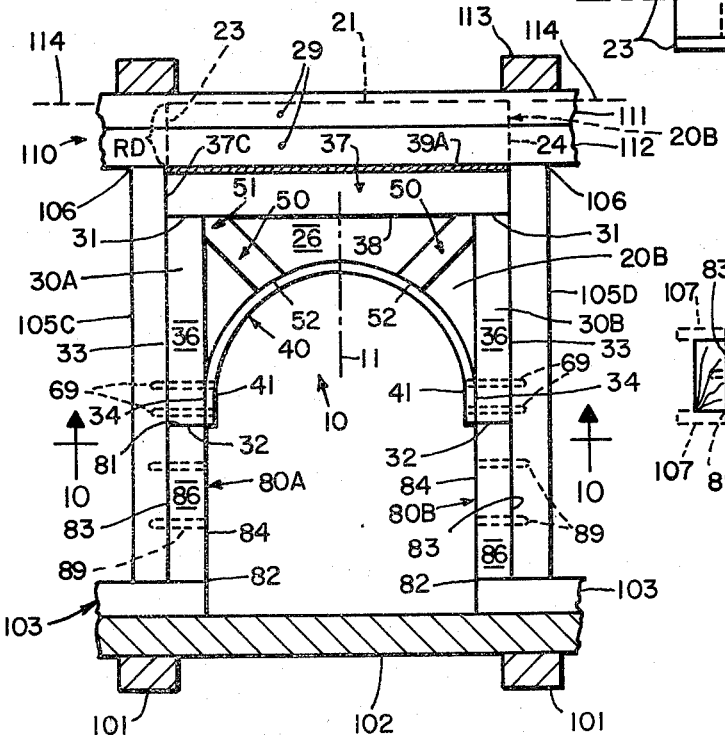
FIG. 9 is an elevational view similar to that of FIG. 6 but showing the module defining the upper portion of an archway being made in the FIGS. 1–1A environment.
Figure 10:
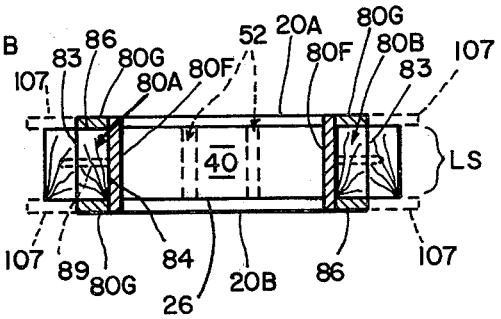
FIG. 10 is a sectional plan view taken along line 10—10 of FIG. 9.

Method steps for installing the prefabricated modules e.g. 10, 70, etc., in the typical internal building wall environment of FIGS. 1–1A, are alluded to in FIGS. 9 and 10. First, the module is placed uprightly within the longitudinal-spacing "SS" and below top-plate 110 whereby rails outer-faces 33 are slidably disposed along upright neighboring studs 105C and 105D. At this time the workman might apply a thin layer of adhesive 39A along the upperside 39 of bar 37. Next, the module is manually lifted upwardly whereby at its top-edge 21 it abuts ceiling level 114, the two panels 20A and 20B abuttably flank the top-plate 110, and the bar upperside 39–39A abuts the underside of top-plate 110. At this time, the workman can drive nails 69 or other fasteners through the archway lower-length e.g. 41, 46, to anchor rails 30 to neighboring studs 105C–105D whereby rail bottom-ends 32 are maintained loftily above floor level 102–103. Nails 29 or other fasteners might be driven through panels 20 to attach the module overhang 37 RD" to top-plate 110.

Next, the workman makes two crutch members 80 having vertical lengths 81–82 equal to the vertical distance between rail bottom-end 32 and floor-riser 103. The crutch members 80A and 80B are preferably made of "2×4" rectangular stock, one of the larger cross-sectional dimensions having lateral-extent "LS" abutting the neighboring studs below rail bottom-ends 32 and maintained thereat as by nails 89 or other fasteners. Thus, the crutches 80, which serve to maintain the module elevation for defining the archway upper portion, have their upper-ends 81 abutting the rails bottom-ends 32 and their lower-ends 82 abutting floor-riser 103. At this time the floor-riser 103 between the exposed vertical surfaces 84 is sawed or otherwise removed from flooring 102. Finally, the three exposed crutch surfaces 84 and 86 are covered with sheathing 80F and 80G, respectively, which sheathing might be strips of drywall or the like. At this time, only the decorative surfacing needs to be applied to the exposed surfaces of the module and to sheathing 80F and 80G to complete the walk-through archway.

From the foregoing, the prefabricated modules and methods for making archways through building internal walls will be readily understood and further explanation is believed to be unnecessary. However, since numerous modifications and changes will readily occur to those skilled in the art, it is not desired to limit the invention to the exact constructions shown and described, and accordingly, all suitable modifications and equivalents may be resorted to, falling within the scope of the appended claims.

What is claimed is as follows:

1. Module for defining the upper portion of an arbitrarily shaped archway through the interior wall of a building having neighboring vertical studs of finite longitudinal-spacing and exceeding the width of the intended archway and having thereatop a longitudinally extending horizontal top-plate having parallel upright shoulders of finite vertical-depth and of finite lateral-separation, said prefabricated and installable module comprising:

A. a pair of parallel upright panels maintained in said finite lateral-separation with internal bracing means located between and attached to said upright panels, the respective panels having co-elevationally aligned horizontal top-edges and co-elevationally aligned bottom-edges whereby there is a module constant vertical-height between the panels' aligned top and bottom edges which is less than the studs' finite vertical-elevation, the respective panels also having aligned vertical first-edges and vertical second-edges defining therebetween a module constant longitudinal-length that is substantially equal to said longitudinal-spacing;

B. said internal bracing means being relegated to a recessed-depth below said panels' top-edges to provide a module overhand portion substantially equivalent to said vertical-depth for fastening alongside both upright shoulders of the top-plate environment, said internal bracing means including a pair of parallel and longitudinally spaced apart rails having vertical inner-faces and outer-faces, the rails' respective outer-faces being conterminous the panels' vertical edges and being juxtaposable along for abutting attachment to upper portions of the two neighboring studs, and each of said rails having a bottom-end conterminous the panels' bottom-edges; and C. arbitrarily shaped archway delineating means attached to both vertical panels and laterally extending therebetween whereby the archway delineating means is of linearly generated contour and its lateral-extent is constant and substantially equivalent said lateral-spacing, said archway delineating means being confined between the vertical rails and having finite lower-length portions in closely spaced relationship along the rails' vertical inner-faces.

2. The prefabricated module of claim 1 wherein the two vertical rails support thereatop a substantially horizontal bar portion of the bracing means, said horizontal bar being substantially parallel to the panels' co-elevationally aligned top-edges and located therebelow a constant finite vertical-depth for permitting ready attachment of the module overhang to the top-plate environment.

3. The module of claim 2 wherein the linearly generated archway delineating means has a finite given-thickness, said finite lower-lengths of the archway delineating means extending said finite given-thickness inwardly of the rails' respective inner-faces.

4. The module of claim 3 wherein there is a longitudinally extending stiffener member removably attached to lower-length portions of the vertical rails to prevent inward compression of the module during interim storage prepatory to installation.

5. The module of claim 2 wherein there are reinforcement means between rectangular panels and attached to the bracing means, said reinforcement means extending from the bracing means and terminating at the archway delineating means at least said finite lower-length above the rail bottom-ends.

6. The module of claim 5 wherein there is a plurality of reinforcement members as strengthening-ribs attached to the rails and bar portions of the bracing means, each said strengthening-rib having an arch-end terminating at the archway delineating means.

7. The module of claim 6 wherein the archway delineating means is attached to the arch-end of each strengthening-rib; and wherein the vertical-height of each module panel is substantially equal to one-half the vertical distance between building floor and ceiling.

8. Method for defining an arbitrarily shaped archway through an interior wall of a building structure being constructed at the stage where said interior wall has longitudinally spaced apart vertical studs of finite longitudinal-spacing and which studs extend for vertical-elevation from floor level to the underside of a longitudinally extending horizontal top-plate having parallel upright shoulders of finite lateral-spacing and vertical-depth, said method being accomplished in the open longitudinal spacing between neighboring vertical studs flanking the situs of the intended archway and comprising the following steps:

A. making a prefabricated module for defining the archway upper portion, said module comprising a pair of parallel upright panels maintained in said finite lateral-spacing with internal bracing means, each of said panels having horizontal top-edge and bottom-edge defining a constant vertical-height less than said vertical-elevation, said internal bracing means being relegated to a recessed-depth below the panels top-edges to provide a module overhang portion and also including a pair of parallel spaced apart vertical rails having vertical outer-faces and a bottom-end, and arbitrarily shaped archway delineating means attached to and laterally extending between the panels;

B. placing the prefabricated module uprightly within the said open longitudinal spacing between the neighboring studs;

C. lifting the module so that its overhang portion abuts the ceiling and also is positioned alongside both shoulders of the top-plate;

D. attaching the module rails to the respective neighboring studs; and

E. placing crutch members in vertical alignment with the module rails directly beneath the bottom-end of each rail to maintain the module elevation above floor level.

9. The method of claim 8 wherein the module is constructed to have a vertical-height substantially equal to one-half the distance between floor and ceiling and is also constructed with a substantially horizontal bar portion for the bracing means and placed upon the rails' top-ends; and wherein fasteners are employed above the bracing means horizontal bar portion for attaching the module overhang to the upright shoulders of the top-plate.

10. The method of claim 8 wherein the module is made with a horizontal bar portion for the bracing means which is placed between and panels upon the rails' top-ends; wherein the module is made with the archway delineating means abutting a lower-length of the bracing means rails; wherein the horizontal bar portion of the bracing means is adhesively attached to the top-plate underside; wherein the module overhang portion is attached to the top-plate upright shoulders with fasteners positioned above said adhesive; wherein the module vertical rails at the lower-length portions is attached to the respective neighboring studs by inserting appropriate fasteners through the archway delineating means; wherein the crutch members are of substantially equal lengths; and wherein drywall or other sheathing material is applied to exposed sides of the crutch members and including in vertical alignment with the lower-length of the archway delineating means.

* * * * *